US011898119B2

(12) United States Patent
Dvorak et al.

(10) Patent No.: US 11,898,119 B2
(45) Date of Patent: Feb. 13, 2024

(54) LUBRICATING OIL COMPOSITIONS WITH RESISTANCE TO ENGINE DEPOSIT AND VARNISH FORMATION

(71) Applicant: AFTON CHEMICAL CORPORATION, Richmond, VA (US)

(72) Inventors: Todd Dvorak, Glen Allen, VA (US); Kenneth Garelick, Mechanicsville, VA (US); Mark Devlin, Glen Allen, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 17/584,089

(22) Filed: Jan. 25, 2022

(65) Prior Publication Data

US 2023/0235243 A1 Jul. 27, 2023

(51) Int. Cl.

| | |
|---|---|
| ***C10M 169/04*** | (2006.01) |
| ***C10M 137/10*** | (2006.01) |
| ***C10M 143/04*** | (2006.01) |
| ***C10M 161/00*** | (2006.01) |
| ***C10N 40/25*** | (2006.01) |
| ***C10N 20/00*** | (2006.01) |

(52) U.S. Cl.

CPC ..... *C10M 169/044* (2013.01); *C10M 137/10* (2013.01); *C10M 143/04* (2013.01); *C10M 161/00* (2013.01); *C10M 2203/003* (2013.01); *C10M 2205/024* (2013.01); *C10M 2223/045* (2013.01); *C10N 2020/019* (2020.05); *C10N 2040/25* (2013.01)

(58) Field of Classification Search

CPC ..... C10M 169/044; C10M 137/10; C10M 143/04; C10M 161/00; C10M 2203/003; C10M 2205/024; C10M 2223/045; C10N 2020/019; C10N 2040/25

See application file for complete search history.

(56) References Cited

U.S. PATENT DOCUMENTS

| | | | | |
|---|---|---|---|---|
| 4,137,185 | A | 1/1979 | Gardiner et al. | |
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,272,387 | A | 6/1981 | King et al. | |
| 4,283,295 | A | 8/1981 | deVries et al. | |
| 4,285,822 | A | 8/1981 | deVries et al. | |
| 4,804,794 | A | 2/1989 | Ver Strate et al. | |
| 4,904,401 | A * | 2/1990 | Ripple | C10M 133/52 508/435 |
| 5,198,401 | A * | 3/1993 | Turner | C08F 10/00 526/170 |
| 5,241,003 | A | 8/1993 | Degonia et al. | |
| 5,427,702 | A | 6/1995 | Chung et al. | |
| 5,650,381 | A | 7/1997 | Gatto et al. | |
| 6,034,184 | A | 3/2000 | Coolbaugh et al. | |
| 6,103,673 | A * | 8/2000 | Sumiejski | C10M 167/00 508/195 |
| 6,162,768 | A | 12/2000 | Coolbaugh et al. | |
| 6,215,033 | B1 | 4/2001 | Coolbaugh et al. | |
| 6,248,702 | B1 | 6/2001 | Coolbaugh et al. | |
| RE37,363 | E | 9/2001 | Gatto et al. | |
| 6,300,291 | B1 | 10/2001 | Hartley et al. | |
| 6,723,685 | B2 | 4/2004 | Hartley et al. | |
| RE38,929 | E | 1/2006 | Gatto et al. | |
| 7,214,649 | B2 | 5/2007 | Loper et al. | |
| RE40,595 | E | 12/2008 | Gatto et al. | |
| 7,645,726 | B2 | 1/2010 | Loper | |
| 8,048,831 | B2 | 11/2011 | Loper | |
| 9,080,126 | B2 | 7/2015 | Hartley et al. | |
| 9,416,206 | B2 * | 8/2016 | Kolb | C10M 143/04 |
| 2006/0068999 | A1 | 3/2006 | Shaw et al. | |
| 2006/0199896 | A1 | 9/2006 | Walton et al. | |
| 2009/0131291 | A1 * | 5/2009 | Kurosawa | C10M 171/02 508/370 |
| 2010/0273692 | A1 * | 10/2010 | Kolb | C08F 210/16 526/348 |
| 2011/0237476 | A1 | 9/2011 | Griffin et al. | |
| 2013/0237463 | A1 | 9/2013 | Yagishita | |
| 2015/0344813 | A1 | 12/2015 | Strong et al. | |
| 2019/0127655 | A1 * | 5/2019 | Dance | C10M 101/02 |
| 2019/0177651 | A1 * | 6/2019 | Loper | C10L 1/236 |
| 2020/0407474 | A1 * | 12/2020 | Zhang | C10M 143/04 |

FOREIGN PATENT DOCUMENTS

WO 94/06897 A1 3/1994

OTHER PUBLICATIONS

Southwest Research Institute Fuels and Lubricants Research Division 2021) Sequence VH Engine Test (ASTM D8256) (swri.org) (Year: 2021).*

ACEA European Oil Sequences Lubrizol (2021) 21-240-acea-2020-oil-sequences_2021-combined-v4.pdf (lubrizol.com) (Year: 2021).*

International Search Report and Written Opinion for corresponding International application No. PCT/US2022/078964; dated Feb. 21, 2023 (9 pages).

* cited by examiner

*Primary Examiner* — James C Goloboy

(74) *Attorney, Agent, or Firm* — Mendelsohn Dunleavy, P.C.

(57) ABSTRACT

A lubricating oil composition comprising greater than 50 wt. % of a base oil of lubricating viscosity, and an additive composition comprising: an amount of one or more zinc dialkyl dithiophosphates (ZDDP compounds) and an amount of one or more viscosity modifiers, wherein an amount of phosphorus (P) in weight percent provided to the lubricating oil composition by the one or more ZDDP compounds divided by the amount of the one or more viscosity modifiers (VM) in weight percent based on a total weight of the lubricating oil composition is a P/VM quotient of more than about 0.0075. The lubricating oil composition can improve resistance to engine deposits and extend oil drain intervals of an internal combustion engine.

11 Claims, No Drawings

LUBRICATING OIL COMPOSITIONS WITH RESISTANCE TO ENGINE DEPOSIT AND VARNISH FORMATION

TECHNICAL FIELD

This disclosure relates to engine lubricating oils with resistance to engine deposit and varnish formation. In particular, this disclosure relates to lubricating oils, and methods for improving resistance to engine deposit and varnish formation of a lubricating oil in an engine or other mechanical component lubricated with the lubricating oil. The lubricating oils of this disclosure are useful as internal combustion engine oils or other applications where lubricating oils are subjected to heat and oxidative conditions.

BACKGROUND

Lubricating oils are an essential part of modem vehicle design for engine operation and protection. During use of hydrocarbon-based lubricants, autoxidation will occur. This process leads to the formation of acids and oil thickening. To a more severe extent, oil-insoluble sludge and varnish may be formed, causing poor lubrication, reduced fuel economy, and increased wear. Antioxidants are additives that are typically incorporated in lubricant formulations to delay the onset of autoxidation and minimize its impact.

Oil varnishing may be the result of a complex string of events. Specifically, the molecules in the oil stream may be broken via chemical, mechanical, and/or thermal processes. For example, chemical processes may include oxidation of the oil. Oxidation may be accelerated by heat and/or the presence of metal particulates therein. Mechanical processes may include "shearing," where the oil molecules may be torn apart as they pass between moving mechanical surfaces. Thermal processes may include pressure-induced thermal degradation due to the high pressures and temperatures. Electrostatic charges also may cause localized thermal-oxidative oil degradation. Other processes and combinations thereof also may be present although not fully understood to date.

There is thus a desire for an additive package for lubricating oil compositions which limit both the creation of oil varnish and the damage caused thereby during use, particularly in valve lifters, piston rings, piston skirts, valve covers, and positive crankcase ventilation (PCV) valves.

SUMMARY AND TERMS

The present disclosure meets the above-described need for an additive package for lubricating oil compositions which limit both the creation of oil varnish and the damage caused thereby during use, particularly in valve lifters, piston rings, piston skirts, valve covers, and PCV valves.

The present disclosure may be described by the following sentences.

1. A lubricating oil composition comprising greater than 50 wt. % of a base oil of lubricating viscosity, and an additive composition comprising:
   an amount of one or more zinc dialkyl dithiophosphates (ZDDP compounds) and an amount of one or more viscosity modifiers, wherein an amount of phosphorus (P) in weight percent provided to the lubricating oil composition by the one or more ZDDP compounds divided by the amount of the one or more viscosity modifiers (VM) in weight percent based on a total weight of the lubricating oil composition is a P/VM quotient of more than about 0.0075.

2. The lubricating oil composition of sentence 1, wherein the PNM quotient may be more than about 0.0077, or more than about 0.0077 and less than 0.1, or more than about 0.0077 and less than 0.03, or more than about 0.0077 and less than 0.02.
3. The lubricating oil composition of sentence 2 or 3, wherein the PNM quotient may be greater than about 0.0075 and the amount of VM is less than 14 wt. %, or the PNM quotient may be greater than about 0.0077 and the amount of VM is less than 13 wt. %, or the PNM quotient may be greater than about 0.0077 and less than 0.03 and the amount of V M is less than 12 wt. %.
4. The lubricating oil composition of any one of the previous sentences, wherein the PNM quotient may be greater than about 0.0075 and the amount of P may be at least 0.064 wt. %, or the PNM quotient may be greater than about 0.0077 and the amount of P may be at least about 0.064 wt. %, or the PNM quotient may be greater than about 0.0077 and less than 0.03 and the amount of P may be at least 0.064 wt. % and less than 0.15 wt. %,
5. The lubricating oil composition of any one of the previous sentences, wherein the one or more ZDDP compounds may be present in the lubricating oil composition in amounts of from about 0.01 wt. % to about 15 wt. %, or about 0.01 wt. % to about 10 wt. %, or about 0.05 wt. % to about 5 wt. %, or about 0.1 wt. % to about 3 wt. % based on the total weight of the lubricating oil composition.
6. The lubricating oil composition of any one of the previous sentences, wherein the amount of the one or more viscosity modifiers may be greater than about 0.5 wt. %; or about 0.5 wt. % to about 30 wt. %; or about 0.9 wt. % to about 25 wt. %; or about 1.0 wt. % to about 25 wt. %; or about 1.0 wt. % to about 18 wt. %, wherein the amount is based on the total weight of the lubricating oil composition.
7. The lubricating oil composition of any one of the previous sentences, wherein the one or more ZDDP compounds may be derived from one or more secondary alkyl alcohol(s) having an alkyl group with 3 to 8 carbon atoms.
8. The lubricating oil composition of any one of the previous sentences, wherein the one or more ZDDP compounds may be derived from a secondary alkyl alcohol selected from the group consisting of isopropyl alcohol, amyl alcohol, and methyl isobutyl carbinol.
9. The lubricating oil composition of any one of the previous sentences, wherein the one or more ZDDP compounds may be derived from two or more secondary alkyl alcohols.
10. The lubricating oil composition of any one of the previous sentences, wherein the one or more ZDDP compounds may be derived from one or more primary alkyl alcohol(s) each having an alkyl group with 3 to 8 carbon atoms.
11. The lubricating oil composition of sentence 10, wherein the alkyl group of the one or more primary alkyl alcohol(s) may have branching at the beta carbon relative to the hydroxyl group.
12. The lubricating oil composition of any one of the previous sentences, wherein the one or more ZDDP compounds may be derived from one or more primary alkyl alcohol selected from the group consisting of n-propyl alcohol, isopropyl alcohol, isobutyl alcohol, n-butyl alcohol, 2-butanol, n-penyl alcohol, hexanol, methyl isobutyl carbinol, isohexanol, n-heptanol, isoheptanol, octanol, amyl alcohol, and 2-ethylhexanol.

13. The lubricating oil composition of any one of the previous sentences, wherein the one or more ZDDP compounds may be derived from two or more primary alkyl alcohols.
14. The lubricating oil composition of any one of the previous sentences, wherein the one or more ZDDP compounds may be a mixture of at least one ZDDP compound derived from 100% primary alcohols and at least one ZDDP compound derived from 100% secondary alcohols.
15. The lubricating oil composition of sentence 14, wherein the mixture may comprise the ZDDP compounds derived from 100% primary alcohols in an amount to contribute 15 to 500 ppmw zinc and the ZDDP compounds derived from 100% secondary alcohols in an amount to contribute 100 to 1000 ppm zinc to the lubricating oil composition based on the total weight of the lubricating oil composition; or the mixture comprises the ZDDP compounds derived from 100% primary alcohols in an amount to contribute 100 to 400 ppmw zinc and the ZDDP compounds derived from 100% secondary alcohols in an amount to contribute 200 to 800 ppm zinc to the lubricating oil composition based on the total weight of the lubricating oil composition.
16. The lubricating oil composition of any one of the previous sentences, wherein the one or more ZDDP compounds may be derived from a mixture of primary and secondary alcohols contributing 200 to 1400 ppmw zinc to the lubricating oil composition based on the total weight of the lubricating oil composition; or the one or more ZDDP compounds is derived from a mixture of primary and secondary alcohols contributing 500 to 1200 ppmw zinc to the lubricating oil composition based on the total weight of the lubricating oil composition.
17. The lubricating oil composition of any one of the previous sentences, wherein the one or more ZDDP compounds may be a mixture of:
    a) one or more ZDDP compounds derived from a mixture of primary and secondary alcohols; and either
        i) one or more ZDDP compounds derived from 100% primary alcohols, or
        ii) one or more ZDDP compounds derived from 100% secondary alcohols.
18. The lubricating oil composition of any one of the previous sentences, wherein the one or more ZDDP compounds may be a mixture of: one or more ZDDP compounds derived from a mixture of primary and secondary alcohols; and one or more ZDDP compounds derived from 100% primary alcohols.
19. The lubricating oil composition of any one of the previous sentences, wherein the one or more ZDDP compounds may be a mixture of: one or more ZDDP compounds derived from a mixture of primary and secondary alcohols; and one or more ZDDP compounds derived from 100% primary alcohols.
20. The lubricating oil composition of any one of the previous sentences, wherein the one or more ZDDP compounds may be derived from a molar ratio of one or more primary alkyl alcohol(s) to one or more secondary alkyl alcohol(s) of from 100:20 to 50:50.
21. The lubricating oil composition of any one of the previous sentences, wherein the one or ZDDP compounds may have a zinc to phosphorus molar ratio of from 1.08 to 1.2.
22. The lubricating oil composition of any one of the previous sentences, wherein the one or more viscosity modifiers may be a non-dispersant viscosity modifier.
23. The lubricating oil composition of sentence 22, wherein the non-dispersant viscosity modifier may be a hydrocarbon polymer.
24. The lubricating oil composition of sentence 23, wherein the hydrocarbon polymer may be a polyolefin which is an ethylene-alpha olefin copolymer or a diene polymer.
25. The lubricating oil composition of sentence 24, wherein the polyolefin may be an oil soluble or dispersible copolymers of ethylene and $C_3$ to $C_{28}$ alpha-olefins, or ethylene and $C_3$ to $C_8$ alpha-olefins, or ethylene and $C_3$ to $C_6$ alpha-olefins, or ethylene and $C_3$ to $C_4$ alpha-olefins.
26. The lubricating oil composition of sentence 24 or 25, wherein the polyolefin may be an ethylene propylene copolymer which is a random copolymer.
27. The lubricating oil composition of any one of sentences 24-26, wherein the polyolefin may be a diene polymer comprising isoprene, butadiene, 2,3-dimethyl-1,3-butadiene, chloroprene, 1,3-butadiene, piperylene, 1-4 hexadiene, ethylidene norbornene, vinyl norbornene, 4-vinyl cyclohexene, dicyclopentadiene and mixtures thereof.
28. The lubricating oil composition of any one of sentences 24-27, wherein the polyolefin may have a weight average molecular weight (Mw) determined by gel-permeation chromatography employing polystyrene standards, ranging from about 7,000 g/mol to about 500,000 g/mol, or from about 20,000 g/mol to about 400,000 g/mol, or from about 100,000 g/mol to about 300,000 g/mol.
29. The lubricating oil composition of any one of sentences 24-28, wherein the polyolefin may have a polydispersity (Mw/Mn) ranging from about 1.5 to about 10, or from about 1.5 to about 3.0, or from about 1.7 to about 3.0, or from about 2.0 to about 2.5.
30. The lubricating oil composition of any one of sentences 24-29, wherein the polyolefin may have a shear stability index (SSI) of from about 3% to about 60%, or from about 5% to about 50%, or from about 15% to about 40%, or from about 20% to about 35%, as measured using test method ASTM-D6278.
31. The lubricating oil composition of any one of the previous sentences, may further comprise at least one additive selected from the group consisting of dispersants, antioxidants, antiwear agents, antifoam agents, molybdenum-containing compounds, titanium-containing compounds, phosphorus-containing compounds, pour point depressants, and diluent oils.
32. The lubricating oil composition of any one of the previous sentences, wherein the lubricating oil composition may provide results of an Average Engine Varnish test (ASTM D8256) of 8.6 or higher, or 8.7 or higher, or 8.7 to about 15.
33. A method of extending an oil drain interval of an internal combustion engine, the method comprising adding to the engine the lubricating oil composition of any one of the previous sentences and operating the engine.

34. A method of reducing engine deposits of an internal combustion engine, the method comprising adding to the engine the lubricating oil composition of any one of sentences 1-32 and operating the engine.

35. A process of improving resistance to engine deposits of an engine oil, the process comprising incorporating an amount of one or more zinc dialkyl dithiophosphates (ZDDP compounds) and an amount of one or more viscosity modifiers, wherein an amount of phosphorus (P) in weight percent provided to the lubricating oil composition by the one or more ZDDP compounds divided by the amount of the one or more viscosity modifiers (VM) in weight percent based on a total weight of the lubricating oil composition is a P/VM quotient of more than about 0.0075,
into a base oil to form the engine oil.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739 or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubrited coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The lubricating oil composition for an internal combustion engine may be suitable for any engine lubricant irrespective of the sulfur, phosphorus, or sulfated ash (ASTM D-874) content. The sulfur content of the engine oil lubricant may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

In one embodiment the lubricating oil composition is an engine oil, wherein the lubricating oil composition may have (i) a sulfur content of about 0.5 wt % or less, (ii) a phosphorus content of about 0.1 wt % or less, and (iii) a sulfated ash content of about 1.5 wt % or less.

In one embodiment the lubricating oil composition is suitable for a 2-stroke or a 4-stroke marine diesel internal combustion engine. In one embodiment the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

Low speed diesel typically refers to marine engines, medium speed diesel typically refers to locomotives, and high speed diesel typically refers to highway vehicles. The lubricating oil composition may be suitable for only one of these types or all.

Further, lubricants of the present description may be suitable to meet one or more industry specification requirements such as ILSAC GF-3, GF-4, GF-5, GF-5+, GF-6, PC-11, CF, CF-4, CH-4, CK-4, FA-4, CJ-4, CI-4 Plus, CI-4, API SG, SJ, SL, SM, SN, SN PLUS, ACEA A1/B1, A2/B2, A3/B3, A3/B4, A5/B5, A7/B7, C1, C2, C3, C4, C5, C6 E4/E6/E7/E9, Euro 5/6, JASO DL-1, Low SAPS, Mid SAPS, or original equipment manufacturer specifications such as Dexos1™, Dexos2™, MB-Approval 229.1, 229.3, 229.5, 22.51/229.31, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Longlife-17 FE+Porsche A40, C30, Peugeot Citroen Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, or lubricating, are designed to meet specific and stringent manufacturer requirements.

The present disclosure provides novel lubricating oil blends formulated for use as automotive crankcase lubricants. The present disclosure provides novel lubricating oil blends formulated for use as 2T and/or 4T motorcycle crankcase lubricants. Embodiments of the present disclosure may provide lubricating oils suitable for crankcase applications and having improvements in the following characteristics: air entrainment, alcohol fuel compatibility, antioxidancy, antiwear performance, biofuel compatibility, foam reducing properties, friction reduction, fuel economy, pre-ignition prevention, rust inhibition, sludge and/or soot dispersability, piston cleanliness, deposit formation, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

This disclosure relates to lubricating oil compositions having improved resistance to sludge deposit and varnish formation in an engine or other mechanical component lubricated with the lubricating oil. The lubricating oils of this disclosure are useful as passenger vehicle engine oil (PVEO) products, commercial vehicle engine oil (CVEO) products, or other applications where lubricating oils are subjected to heat and oxidative conditions.

In an aspect, the lubricating oil composition comprises greater than 50 wt. % of a base oil of lubricating viscosity, and an additive composition comprising: an amount of one or more zinc dialkyl dithiophosphates (ZDDP compounds) and an amount of one or more viscosity modifiers, wherein the amount of phosphorus (P) in weight percent provided to the lubricating oil composition by the one or more ZDDP compounds divided by the amount of the one or more viscosity modifiers (VM) in weight percent based on the total weight of the lubricating oil composition is a PNM quotient of more than about 0.0075.

ZDDP has antioxidant and antiwear functionalities. Without being bound to theory, it is believed that the ZDDP acts as an oxidation inhibitor to minimize the formation of deposit and varnish precursors, such as hydroperoxides and radicals. These species are reactive, and they attack the hydrocarbon base oil and additives, which make up the lubricant, to form sludge, resin, varnish, and hard deposits. The viscosity modifier works in coordination with the ZDDP, with improvements in low-temperature rheology and thickening efficiency. This not only results in improved deposit and varnish control but also minimizes particulate-related abrasive wear and viscosity increase.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+may comprise high viscosity index Group II.

The base oil used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful.

Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Zinc Dialkyl Dithiophosphate Compound(s)

The lubricating oil composition of the disclosure for use in an internal combustion engine to improve resistance to sludge deposit and varnish formation contains an amount of one or more zinc dialkyl dithiophosphates (ZDDP compounds). The one or more ZDDP compounds can also aid to improve friction and wear properties of the lubricating oil composition.

The one or more ZDDP compounds can be present in the lubricating oil composition in amounts of from about 0.01 wt. % to about 15 wt. %, or about 0.01 wt. % to about 10 wt. %, or about 0.05 wt. % to about 5 wt. %, or about 0.1 wt. % to about 3 wt. % based on the total weight of the lubricating oil composition.

The one or more ZDDP compounds can comprise ZDDP compounds derived from primary alkyl alcohols, secondary alkyl alcohols, or a combination of primary and secondary alkyl alcohols. The primary alkyl alcohols and secondary alkyl alcohols used to prepare the one or more ZDDP compounds may have an alkyl group including 1 to 20 carbon atoms, or from about 1 to 18 carbon atoms, or from about 1 to about 16 carbon atoms, or 2 to 12 carbon atoms, or about 3 to about 8 carbon atoms. Preferably, the primary alkyl alcohols have branching at the beta carbon relative to the hydroxyl group.

For example, an alcohol with branching at the beta (p) carbon, would be branching at the second carbon counted from the oxygen atom of the hydroxyl group.

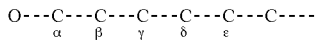

Suitable examples of primary alkyl alcohols and secondary alkyl alcohols for use in preparing the one or more ZDDP compounds may be selected from the group consisting of n-propyl alcohol, isopropyl alcohol, n-butyl alcohol, 2-butanol, isobutyl alcohol, n-pentyl alcohol, amyl alcohol, hexanol, methyl isobutyl carbinol, isohexanol, n-heptanol, isoheptanol, octanol, nonanol, decanol, undecanol, dodecanol, tridecanol, tetradecanol, pentadecanol, hexadecanol, heptadecanol, octadecanol, nonadecanol, eicosanol, and 2-ethylhexanol.

In some embodiments, the additive composition may comprise at least two different zinc dialkyl dithiophosphate compound(s). The two alkyl groups on the zinc dialkyl dithiophosphate compound(s) may be the same or different.

In some embodiments, the one or more ZDDP compounds may be present in the lubricating oil in an amount sufficient to provide from about 100 to about 1500 ppmw phosphorus, or from about 200 to about 1300 ppmw phosphorus, or from about 300 to about 1200 ppmw phosphorus, or from about 550 to about 1200 ppmw phosphorus, based on the total weight of the lubricating oil composition.

In some embodiments, the one or more ZDDP compounds may be present in the lubricating oil in an amount sufficient to provide from about 10 ppmw zinc to about 1500 ppmw zinc, or from about 100 ppmw zinc to about 1300 ppmw zinc, or from about 600 ppmw zinc to about 1200 ppmw zinc, based on the total weight of the lubricating oil composition.

In some embodiments, 100 mole percent of the alkyl groups of the one or more one or more ZDDP compounds may be derived from one or more primary alcohol groups. In some embodiments, 100 mole percent of the alkyl groups of the one or more one or more ZDDP compounds may be derived from one or more secondary alcohol groups. In some embodiments, mixtures of one or more all primary alcohol ZDDP compounds and one or more all secondary alcohol ZDDP compounds are provided. In some embodiments, the mixture comprises one or more all primary alcohol ZDDP compounds contributing 15 to 500 ppmw zinc and one or more all secondary alcohol ZDDP compounds contributing 100 to 1000 ppm zinc to the lubricating oil composition based on the weight of the lubricating oil composition; or the mixture comprises one or more all primary alcohol ZDDP compounds contributing 100 to 400 ppmw zinc and one or more all secondary alcohol ZDDP compounds contributing 200 to 800 ppm zinc to the lubricating oil composition based on the weight of the lubricating oil composition. In some embodiments, the mixture comprises one or more all primary alcohol ZDDP compounds contributing 10 to 450 ppmw phosphorus and one or more all secondary alcohol ZDDP compounds contributing 100 to 1000 ppm phosphorus to the lubricating oil composition based on the weight of the lubricating oil composition; or the mixture comprises one or more all primary alcohol ZDDP compounds contributing 100 to 375 ppmw phosphorus and one or more all secondary alcohol ZDDP compounds contributing 300 to 800 ppm phosphorus to the lubricating oil composition based on the weight of the lubricating oil composition.

In some embodiments, the one or more ZDDP compounds is formed with a mixture of primary and secondary alcohols. The molar ratio of primary alkyl alcohol to secondary alkyl alcohol used to make the one or more ZDDP compounds in the lubricating oil composition can be from about 100:0 to 0:100, or from about 100:0 to 50:50, or from 100:0 to 60:40. The one or more ZDDP compounds may have a P:Zn molar ratio of from about 1.08 to 1.3, or from about 1.08 to 1.2, or from about 1.09 to about 1.15. In some embodiments, the one or more ZDDP compounds formed with a mixture of primary and secondary alcohols contributes 50 to 1500 ppmw zinc based on the weight of the lubricating oil composition; or the one or more ZDDP compounds formed with a mixture of primary and secondary alcohols contributes 400 to 1300 ppmw zinc based on the weight of the lubricating oil composition. In some embodiments, the one or more ZDDP compounds formed with a mixture of primary and secondary alcohols contributes 40 to 1400 ppm phosphorus to the lubricating oil composition based on the weight of the lubricating oil composition; or the one or more ZDDP compounds formed with a mixture of primary and secondary alcohols contributes 350 to 1200 ppm phosphorus to the lubricating oil composition based on the weight of the lubricating oil composition.

In some embodiments, the mixture comprises one or more all secondary alcohol ZDDP compounds contributing 100 to 750 ppmw zinc and one or more ZDDP compounds formed with a mixture of primary and secondary alcohols contributes contributes 100 to 750 ppm zinc to the lubricating oil composition based on the weight of the lubricating oil composition; or the mixture comprises one or more all secondary alcohol ZDDP compounds contributing 300 to 600 ppmw zinc and one or more ZDDP compounds formed with a mixture of primary and secondary alcohols contributes 300 to 6000 ppm zinc to the lubricating oil composition based on the weight of the lubricating oil composition.

The alcohols suitable for producing the one or more ZDDP compounds may be primary alkyl alcohols, secondary alkyl alcohols, or a mixture of primary and secondary alcohols. The alcohols may contain any of branched, cyclic, or straight chains.

The one or more ZDDP compounds may be oil soluble salts of dihydrocarbyl dithiophosphoric acids and may be represented by the following formula:

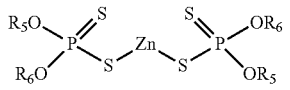

wherein $R_5$ and $R_6$ may be the same or different alkyl groups containing from 1 to 20 carbon atoms, or from about 1 to 18 carbon atoms, or from about 1 to about 16 carbon atoms, or 2 to 12 carbon atoms, or about 3 to about 8 carbon atoms, and including moieties such as alkyl, and cycloalkyl moieties. Thus, the moieties may, for example, be ethyl, n-propyl, i-propyl, n-butyl, i-butyl, sec-butyl, amyl, n-hexyl, i-hexyl, 4-methyl-pentyl, n-octyl, decyl, dodecyl, undecyl, dodecyl, tridecyl, tetradecyl, pentadecyl, hexadecyl, heptadecyl, octadecyl, 2-ethylhexyl, nonadecyl, eicosyl, 2-ethylhexyl, cyclohexyl, or methylcyclopentyl.

The average number of total number of carbon atoms per mole of phosphorus for a ZDDP compound may be calculated by dividing by two the sum of the carbon atoms in the four alkyl groups $R_5$ and $R_6$ provided to the ZDDP compound by alcohol(s) used to make the ZDDP compound. For example, for a single ZDDP compound, if $R_5$ is a $C_3$-alkyl group and $R_6$ is a $C_6$ alkyl group, the total number of carbon atoms is 3+3+6+6=18. Dividing this by two moles of phosphorus per mole of ZDDP gives an average total number of carbon atoms per mole of phosphorus of 9.

The average total number of carbon atoms per mole of phosphorus (ATCP) for compositions containing one or more ZDDP compounds may be calculated from the alcohol(s) used to make the ZDDP compounds according to the following formula:

ATCP=2*[(mol % of *alc*1*#of C atoms in *alc*1)+ (mol % of *alc*2*#of C atoms in *alc*2)+(mol % of *alc*3*#of C atoms in *alc*3)+ . . . etc.]

wherein alc1, alc2 and alc3 each represent a different alcohol used to make the ZDDP compound(s) and the mol % is the molar percentage of each of the alcohols that was present in the reaction mixture used to make the ZDDP compound(s). The "etc." indicates that if more than three alcohols are used to make the ZDDP compounds(s), the formula can be expanded to include each of the alcohols present in the reaction mixture.

The average total number of carbon atoms from both $R_5$ and $R_6$ in the ZDDP is greater than 2 carbon atoms per mole of phosphorus, and in one embodiment in the range from greater than 4 to 40 carbon atoms, or from greater than 6 to about 20 carbon atoms, and in one embodiment in the range from greater than 6 to about 16 carbon atoms, and in one embodiment in the range from about 6 to about 15 carbon atoms, and in one embodiment in the range from about 9 to about 15 carbon atoms, and in one embodiment about 12 carbon atoms per mole of phosphorus.

The dialkyl dithiophosphate zinc compounds may be prepared in accordance with known techniques by first forming a dialkyl dithiophosphoric acid (DDPA), usually by reaction of one or more alcohols and then neutralizing the formed DDPA with a zinc compound. To make the zinc compound, any basic or neutral zinc compound could be used but the oxides, hydroxides, and carbonates are most generally employed. The zinc dialkyl dithiophosphates of component (i) may be made by a process such as the process generally described in U.S. Pat. No. 7,368,596.

The use of one or more ZDDP compounds derived from a molar ratio of primary alkyl alcohol to secondary alkyl alcohol of from about 100:0 to about 0:100 unexpectedly provides increased viscosity control across a wide variety of ZDDP compounds relative to the same lubricating oil compositions except lacking ZDDP compounds. Specifically, to improve viscosity control the use of one or more ZDDP compounds derived from 100 mole percent of one or more secondary alkyl alcohols, and/or one or more ZDDP compounds derived from 100 mole percent of one or more primary alkyl alcohols, unexpectedly provided increased viscosity control.

Also, the use of one or more ZDDP compounds derived from all secondary alkyl alcohol to one or more ZDDP compounds derived from all primary alkyl alcohol is in a molar ratio ranging from 100:0 to 0.2:1; or from 10:1 to 0.4:1; or from 6:1 to 0.75:1 provides improved friction and/or wear results and/or viscosity control across a wide variety of ZDDP compounds relative to lubricating oil compositions except lacking ZDDP compounds.

The present invention can include overbased ZDDP's which are basic ZDDP's. The term basic ZDDP's or equivalent expressions, is used herein to describe those zinc salts wherein the metal substituent is present in stoichiometrically greater amounts than the phosphorus acid radical. For instance, normal or neutral zinc phosphorodithioate has two equivalents (i.e., 1 mole) of zinc per two equivalents (i.e., 2 moles) of a phosphorodithioic acid, whereas a basic zinc diorganophosphorodithioate has more than two equivalents of zinc per two equivalents of the phosphorodithioic acid.

For instance, the overbasing can be performed with a basic zinc compound such as zinc oxide. The amount of basic zinc compound required to give the desired overbasing is not critical. The essential factor is that there be present in the reaction mixture sufficient zinc compound for the overbasing reaction. Although it is not absolutely essential, it has been found that the reaction proceeds in a more satisfactory way if a slight excess of zinc compound over the amount required for reaction is used. This excess should be kept at a minimum level to the necessity for removing large amounts of solid from the final product. As a general statement, the excess of zinc compound should not exceed 10-15 percent by weight.

Viscosity Modifier

The lubricating oil composition of the disclosure comprises one or more viscosity modifiers (also known as viscosity index improvers and viscosity improvers). Viscosity modifiers provide lubricants with high and low temperature operability. These additives impart shear stability at elevated temperatures and acceptable viscosity at low temperatures. The viscosity modifier works in coordination with the ZDDP, with improvements in low-temperature rheology and thickening efficiency. This not only results in improved deposit and varnish control but also minimizes particulate-related abrasive wear and viscosity increase.

The viscosity modifiers may be one or more dispersant viscosity modifiers that function as both a viscosity modifier and a dispersant. Preferably, the lubricating oil composition comprises one or more non-dispersant viscosity modifiers.

The one or more non-dispersant viscosity modifiers can be a hydrocarbon polymer which may be a polyolefin having a main chain consisting essentially of aliphatic olefin, especially alpha olefin, monomers. The polyolefins of this embodiment thus exclude polymers which have a large component of other types of monomers copolymerized in the main polymer, such as ester monomers, acid monomers, and the like. The polyolefin may contain impurity amounts of such materials, e.g., less than 5% by weight, more often less than 1% by weight, preferably, less than 0.1% by weight of other monomers. Useful polymers include oil soluble or dispersible copolymers of ethylene and $C_3$ to $C_{28}$ alpha-olefins, or ethylene and $C_3$ to $C_8$ alpha-olefins, or ethylene and $C_3$ to $C_6$ alpha-olefins, or ethylene and $C_3$ to $C_4$ alpha-olefins.

The olefin copolymers (sometimes referred to as polyolefins) may be random copolymers, block copolymers, and random block copolymers. Ethylene propylene copolymers are usually random or statistical copolymers. Random or statistical copolymers can be a mixture of two or more polymers made in two or more reactors in series. Block copolymers may be obtained by conducting the reaction in a tubular reactor. Such a procedure is described in U.S. Pat. No. 4,804,794 which is hereby incorporated by reference for relevant disclosures in this regard. These polymers are available commercially as PARATONE® 8941 and PARATONE® 8910 (marketed by Chevron Oronite Company L.L.C.). Block copolymers can also be obtained by selecting appropriate catalyst and/or process for the polymerization. Such polymers are described in U.S. Pregrant Publication No. 2006/0199896 which is hereby incorporated by reference for relevant disclosures in this regard. Such olefin block copolymers are sold commercially by Dow Chemical's under trade name INFUSE™ olefin block copolymers.

Numerous United States patents, including the following, describe the preparation of copolymers of alpha olefins. Copolymers of ethylene with higher alpha olefins are the most common copolymers of aliphatic olefins. Ethylene-propylene copolymers are the most common ethylene-alpha-olefin copolymers and are preferred for use in this invention. A description of an ethylene-propylene copolymer appears in U.S. Pat. No. 4,137,185 which is hereby incorporated herein by reference. Useful ethylene-alpha olefin, usually ethylene-propylene, copolymers are commercially available. Ethylene-alpha olefin copolymer comprising from about 30 to about 60 weight percent monomer units derived from ethylene are generally referred as low ethylene or amorphous copolymers. Ethylene alpha-olefin copolymer comprising from about 60 to about 80 weight percent units derived from ethylene are generally referred as high ethylene (semi-crystalline) polymers. In an embodiment, the one or more non-dispersant viscosity modifiers is an ethylene-propylene copolymer having about 40 to about 60 weight percent ethylene and about 60 to about 40 weight percent propylene, wherein the weight percent is based on the total weight of the olefin polymer. In another embodiment, the olefin polymer is an ethylene-propylene copolymer having about 45 to about 55 weight percent ethylene and about 55 to about 45 weight percent propylene, wherein the weight percent is based on the total weight of the olefin polymer. In another embodiment, the olefin polymer is an ethylene-propylene copolymer having a higher weight percent of ethylene than the weight percent propylene, wherein the weight percent is based on the total weight of the olefin polymer. The polymer substrate (i.e., the portion of the olefin polymer that is the backbone not including substituents) can also contain mixtures of amorphous and semi-crystalline polymers in weight ratios as described in U.S. Pat. No. 5,427,702 which hereby is incorporated by reference. The typical polymers available commercially that include amorphous copolymers are PARATONE® 8921 available from Chevron Oronite, LZ7067, LZ7065 and LZ7060 available from the Lubrizol Corporation, Keltan® 1200A, 1200B available from Lanxess and NDR125 available from Dow Chemical Company.

The olefin polymer (sometimes referred to as polyolefins) having a main chain consisting essentially of aliphatic olefin can be a polymer comprising dienes. The olefin polymer may be a homopolymer or copolymer of one or more dienes.

The dienes may be conjugated such as isoprene, butadiene, 2,3-dimethyl-1,3-butadiene, chloroprene, 1,3-butadiene and piperylene or non-conjugated such as 1-4 hexadiene, ethylidene norbornene, vinyl norbornene, 4-vinyl cyclohexene, and dicyclopentadiene. Polymers of conjugated dienes are preferred. In an embodiment, the total carbon content of the diene may not exceed 20 carbons. Such polymers are conveniently prepared via free radical and anionic polymerization techniques. Emulsion techniques are commonly employed for free radical polymerization.

The olefin polymer having a main chain consisting essentially of aliphatic olefin can be copolymers of conjugated dienes with vinyl substituted aromatic compounds. In one embodiment, the olefin polymer is a copolymer of a vinyl-substituted aromatic compound and a conjugated diene. The vinyl substituted aromatics generally contain from 8 to about 20 carbons, preferably from 8 to 12 carbon atoms and most preferably, 8 or 9 carbon atoms. Examples of vinyl substituted aromatics include vinyl anthracenes, vinyl naphthalenes and vinyl benzenes (styrenic compounds). Styrenic compounds are preferred, examples being styrene, alpha-methylstyrene, ortho-methyl styrene, meta-methyl styrene, para-methyl styrene, para-tertiary-butylstyrene and chlorostyrene, with styrene being preferred. The vinyl substituted aromatic content of these copolymers is typically in the range of about 15% to about 70% by weight, or about 20% to about 40% by weight based on the total weight of the copolymer. The aliphatic conjugated diene content of these copolymers is typically in the range of about 30% to about 85% by weight, or about 60% to about 80% by weight based on the total weight of the copolymer.

The polymers, and in particular, styrene-diene copolymers, can be random copolymers or block copolymers, which include regular block copolymers or random block copolymers. Random copolymers are those in which the comonomers are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a larger number of relatively short segments of homopolymer of one type of monomer alternate with relatively short segments of homopolymer of another monomer. Block copolymers, particularly diblock copolymers are preferred. Examples of such polymer substrate is illustrated by U.S. Pat. Nos. 6,162,768; 6,215,033; 6,248,702 and 6,034,184 which is hereby incorporated by reference.

The random, regular block and random block polymers used in this invention may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer. The sizes of the blocks are not necessarily the same, but may vary considerably. The only stipulation is that any regular block copolymer comprises relatively few, but relatively large, alternating homopolymer segments.

These olefin polymers having a main chain consisting essentially of aliphatic olefin can be hydrogenated to reduce the amount of olefinic unsaturation present in the polymer. They may or may not be exhaustively hydrogenated. Hydrogenation is often accomplished employing catalytic methods. Catalytic techniques employing hydrogen under high pressure and at elevated temperature are well-known to those skilled in the chemical art. Other methods are also useful and are well known to those skilled in the art. Extensive discussions of diene polymers appear in the "Encyclopedia of Polymer Science and Engineering", Volume 2, pp. 550-586 and Volume 8, pp. 499-532, Wiley-Interscience (1986), which are hereby: expressly incorporated herein by reference for relevant disclosures in this regard. As a specific example, U.S. Pat. No. 3,959,161 teaches the preparation of hydrogenated polybutadiene. In another example, upon hydrogenation, 1,4-polyisoprene becomes an alternating copolymer of ethylene and propylene. Copolymers of conjugated dienes are prepared from two or more conjugated dienes. Useful dienes are the same as those described in the preparation of homopolymers of conjugated dienes hereinabove. For example, U.S. Pat. No. 4,073,737 describes the preparation and hydrogenation of butadiene-isoprene copolymers.

The olefin copolymer may have a weight average molecular weight (Mw) determined by gel-permeation chromatography employing polystyrene standards, ranging from about 7,000 g/mol to about 500,000 g/mol, or from about 20,000 g/mol to about 400,000 g/mol, or from about 100,000 g/mol to about 300,000 g/mol. The olefin copolymer may have a number average molecular weight (Mn) determined by gel-permeation chromatography employing polystyrene standards, ranging from about 2,000 g/mol to about 400,000 g/mol, or from about 20,000 g/mol to about 200,000 g/mol, or from about 50,000 g/mol to about 150,000 g/mol. Exemplary polydispersity values (Mw/Mn) range from about 1.1 to about 10, or from about 1.2 to about 3.0, or from about 1.3 to about 3.0, or from about 1.3 to about 2.2.

Suitable viscosity modifiers include high molecular weight polyesters or functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine. Typical molecular weights (Mw) of these polymers are between 10,000 g/mol to 1,500,000 g/mol, more typically 20,000 g/mol to 1,200,000 g/mol, and even more typically between 50,000 g/mol and 1,000,000 g/mol determined by gel-permeation chromatography employing polystyrene standards.

Examples of suitable viscosity modifiers include linear or star-shaped polymers and copolymers of methacrylate (such as copolymers of various chain length alkyl methacrylates).

A suitable nondispersant olefin copolymer viscosity modifier is a non-polar hydrogenated olefin copolymer-type viscosity modifier such as the LUBRIZOL 7075™ Series made by LUBRIZOL (Wickliffe, Ohio). Hydrogenated olefin copolymers are the most widely used type of viscosity modifier for passenger car motor oils and heavy-duty diesel engine oils. Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5754A"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

The shear stability index (SSI) of the polymer substrate (i.e., the portion of the olefin polymer that is the backbone not including substituents) typically range from about 3% to about 60%, or from about 5% to about 50%, or from about 15% to about 40%, or from about 20% to about 30%. The SSI is measured using test method ASTM-D6278 which evaluates the shear stability of polymer-containing fluids. The test method measures the percent viscosity loss at 100° C. of polymer-containing fluids when evaluated by a diesel injector apparatus procedure that uses European diesel injector test equipment. The viscosity loss reflects polymer degradation due to shear at the nozzle.

In an embodiment of this disclosure, the viscosity modifiers and/or dispersant viscosity modifiers may be used in an amount is greater than about 0.5 wt. %; or about 0.5 wt. % to about 30 wt. %; or about 0.9 wt. % to about 25 wt. %; or about 1.0 wt. % to about 25 wt. %; or about 1.0 wt. % to about 20 wt. %, wherein the amount is based on the total weight of the lubricating oil composition.

For example, an amount of phosphorus (P) in weight percent provided in the lubricating oil composition by the one or more ZDDP compounds divided by the amount of the one or more viscosity modifiers (VM) in weight percent based on the total weight of the lubricating oil composition is a PNM quotient of more than 0.0075, or is more than about 0.77, or more than about 0.0077 to less than 0.1, or more than about 0.0077 and less than 0.03, or more than about 0.0077 and less than 0.02. For example, the PNM quotient may be greater than about 0.0075 and the amount of VM is less than 0.14 wt. %, or the PNM quotient is greater than about 0.0077 and the amount of VM is less than 13 wt. %, or the PNM quotient is greater than about 0.007 and less than 0.03 and the amount of VM is less than 12 wt. %.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2): (0 to 2): (0 to 1).

The one or more antioxidant(s) may be present in ranges about 0 wt % to about 20 wt %, or about 0.1 wt % to about 10 wt %, or about 0.4 wt % to about 4 wt %, of the lubricating oil composition.

Antiwear Agents

The lubricating oil compositions herein also may optionally contain one or more antiwear agents in addition to the one or more ZDDP compounds discussed above. Examples of suitable antiwear agents include, but are not limited to, a metal thiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. Dialkyl dithio phosphate salts may be used having a metal other than zinc, such as an alkali metal, alkaline earth metal, aluminum, lead, tin, molybdenum, manganese, nickel, copper, or titanium.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents

The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater, as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1, or greater.

The one or more detergents may be a low-based/neutral detergent having a TBN of up to 175 mg KOH/g, or up to 150 mg KOH/g. The low-based/neutral detergent can be formed from a detergent substrate salted with an alkali or another alkaline earth metal such as, but not limited to, calcium, magnesium, potassium, sodium, lithium, barium, or mixtures thereof. In some embodiments, the detergent is free of barium. The low-based/neutral detergent may be selected from a sulfonate, phenate or salicylate detergent. In some embodiments, the low-based/neutral detergent is a calcium-containing detergent or a mixture of calcium-containing detergents. In some embodiments, the low-based/neutral detergent is a calcium sulfonate detergent or a calcium phenate detergent. In an embodiment, the one or more detergents comprises a mixture of one or more low-based/neutral calcium-containing detergents and one or more overbased calcium-containing detergents.

The one or more detergents may comprise an overbased calcium-containing detergent and a low-based/neutral detergent which is a salt of an alkali or alkaline earth metal other than calcium.

The amount of calcium provided by the one or more calcium-containing detergents is greater than about 0.01 wt. %; or greater than about 0.02 wt. %; or up to about 0.25 wt. %; or about 0.010 wt. % to about 0.25 wt. %; or about 0.02 wt. % to about 0.20 wt. %; or about 0.02 wt. % to about 0.15 wt. %, wherein the amount is based on the total weight of the lubricating oil composition.

The low-based/neutral detergent may provide calcium in an amount that comprises at least 0.001 wt % of the calcium provided by the total detergent in the lubricating oil composition. In some embodiments, the low-based/neutral detergent may provide calcium in an amount that comprises at least 0.003 wt %, or 0.003 wt % to 0.05 wt. % of the calcium provided by the total detergent in the lubricating oil composition.

In certain embodiments, the one or more low-based/neutral detergents provide from about 1 to about 400 ppmw calcium by weight to the lubricating oil composition based on a total weight of the lubricating oil composition. In some embodiments, the one or more low-based/neutral calcium-containing detergents provide from 1 to 350 ppmw by weight calcium to the lubricating oil composition based on a total weight of the lubricating oil composition.

In some embodiments, a detergent is effective at suspending harmful products formed in the lubricating oil composition during engine use.

The detergent may be present at about 0 wt % to about 10 wt %, or about 0.1 wt % to about 8 wt %, or about 1 wt % to about 4 wt %, or greater than about 4 wt % to about 8 wt %.

Dispersants

The lubricating oil composition may optionally further comprise one or more dispersants other than the dispersant viscosity modifier discussed above. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000, as determined by GPC, may be suitable. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with:

Inorganic phosphorous acids or anhydrates (e.g., U.S. Pat. Nos. 3,403,102 and 4,648,980);

Organic phosphorous compounds (e.g., U.S. Pat. No. 3,502,677);

Phosphorous pentasulfides;

Boron compounds as already noted above (e.g., U.S. Pat. Nos. 3,178,663 and 4,652,387);

Carboxylic acid, polycarboxylic acids, anhydrides and/or acid halides (e.g., U.S. Pat. Nos. 3,708,522 and 4,948,386);

Epoxides polyepoxiates or thioexpoxides (e.g., U.S. Pat. Nos. 3,859,318 and 5,026,495);

Aldehyde or ketone (e.g., U.S. Pat. No. 3,458,530);

Carbon disulfide (e.g., U.S. Pat. No. 3,256,185);

Glycidol (e.g., U.S. Pat. No. 4,617,137);

Urea, thourea or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811);

Alkenyl cyanide (e.g., U.S. Pat. Nos. 3,278,550 and 3,366,569);

Diketene (e.g., U.S. Pat. No. 3,546,243);

A diisocyanate (e.g., U.S. Pat. No. 3,573,205);

Alkane sultone (e.g., U.S. Pat. No. 3,749,695);

1,3-Dicarbonyl Compound (e.g., U.S. Pat. No. 4,579,675);

Sulfate of alkoxylated alcohol or phenol (e.g., U.S. Pat. No. 3,954,639);

Cyclic lactone (e.g., U.S. Pat. Nos. 4,617,138; 4,645,515; 4,668,246; 4,963,275; and 4,971,711);

Cyclic carbonate or thiocarbonate linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. No. 4,971,598 and British Patent GB 2,140,811);

Hydroxy-protected chlorodicarbonyloxy compound (e.g., U.S. Pat. No. 4,614,522);

Lactam, thiolactam, thiolactone or ditholactone (e.g., U.S. Pat. Nos. 4,614,603 and 4,666,460);

Cyclic carbonate or thiocarbonate, linear monocarbonate or plycarbonate, or chloroformate (e.g., U.S. Pat. Nos. 4,612,132; 4,647,390; 4,646,860; and 4,670,170);

Nitrogen-containing carboxylic acid (e.g., U.S. Pat. No. 4,971,598 and British Patent GB 2,440,811);

Hydroxy-protected chlorodicarbonyloxy compound (e.g., U.S. Pat. No. 4,614,522);

Lactam, thiolactam, thiolactone or dithiolactone (e.g., U.S. Pat. Nos. 4,614,603, and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);

Combination of a hydroxyaliphatic carboxylic acid and then an aliphatic dicarboxylic acid (e.g., U.S. Pat. No. 4,663,064);

Combination of formaldehyde and a phenol and then glycolic acid (e.g., U.S. Pat. No. 4,699,724);

Combination of a hydroxyaliphatic carboxylic acid or oxalic acid and then a diisocyanate (e.g. U.S. Pat. No. 4,713,191);

Combination of inorganic acid or anhydride of phosphorus or a partial or total sulfur analog thereof and a boron compound (e.g., U.S. Pat. No. 4,857,214);

Combination of an organic diacid then an unsaturated fatty acid and then a nitrosoaromatic amine optionally followed by a boron compound and then a glycolating agent (e.g., U.S. Pat. No. 4,973,412);

Combination of an aldehyde and a triazole (e.g., U.S. Pat. No. 4,963,278);

Combination of an aldehyde and a triazole then a boron compound (e.g., U.S. Pat. No. 4,981,492);

Combination of cyclic lactone and a boron compound (e.g., U.S. Pat. Nos. 4,963,275 and 4,971,711). The above mentioned patents are herein incorporated in their entireties.

The TBN of a suitable dispersant may be from about 10 to about 65 on an oil-free basis, which is comparable to about 5 to about 30 TBN if measured on a dispersant sample containing about 50% diluent oil. TBN is measured by the method of ASTM D2896.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, or about 0.1 to about 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Friction Modifiers

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a diester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-Containing Component

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo203$C_{16}$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl-(or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_2$ carboxylic acid. The reaction product may be represented by the following formula:

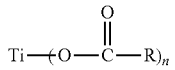

wherein n is an integer selected from 2, 3 and 4, and R is a hydrocarbyl group containing from about 5 to about 24 carbon atoms, or by the formula:

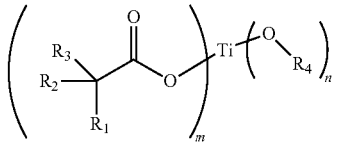

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or by the formula:

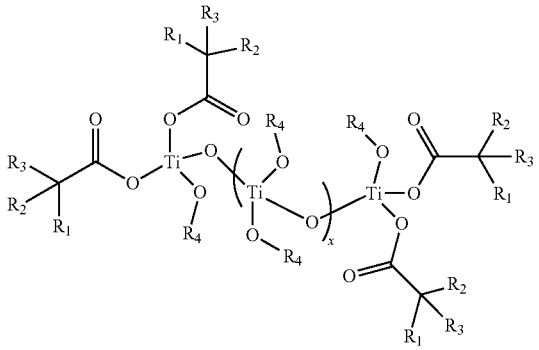

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Other Optional Additives

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable crankcase lubricant may include additive components in the ranges listed in the following table.

TABLE 2

| Component | Wt. % (Suitable Embodiments) | Wt. % (Suitable Embodiments) |
|---|---|---|
| Dispersant(s) | 0.1-20.0 | 1.0-10.0 |
| Antioxidant(s) | 0.1-5.0 | 0.01-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) (on a liquid/dilute basis) | 0.0-25.0 | 0.1-15.0 |
| Dispersant viscosity index improver(s) | 0.0-10.0 | 0.0-5.0 |
| Friction modifier(s) | 0.0-5.0 | 0.01-2.0 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

Examples

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the disclosure. All patents and publications cited herein are fully incorporated by reference herein in their entirety.

Each of the lubricating oil compositions contained a major amount of a base oil and a base conventional dispersant inhibitor (DI) package. The DI package contained conventional amounts of dispersant(s), antiwear additive(s), antioxidant(s), friction modifier(s), antifoam agent(s), process oil(s), viscosity index improver(s), and pour point depressant(s), as set forth in Table 3. Specifically, the DI package contained a succinimide dispersant, a molybdenum-containing compound, an antioxidant, and an antifoam agent. The major amount of base oil was a mixture of Group II and Group III base oils. The components that were varied are specified in the Tables and discussion of the Examples below. All the values listed are states as weight percent of the component in the lubricating oil compositions (i.e., active ingredient plus diluent oil, if any) unless specified otherwise.

TABLE 3

| DI Package Composition Ranges | |
|---|---|
| Component | Wt. % |
| Antioxidant(s) | 0.5 to 2.5 |
| Antifoaming agent(s) | 0.001 to 0.05 |

TABLE 3-continued

| DI Package Composition Ranges | |
|---|---|
| Component | Wt. % |
| Detergent(s) | 0.1 to 2.5 |
| Dispersant(s) | 0 to 6.2 |
| Metal-containing friction modifier(s) | 0-1.5 |
| Metal free friction modifier(s) | 0 to 0.5 |
| Pour point depressant(s) | 0.01 to 0.5 |
| Process oil | 0.25 to 1.0 |
| ZDDP | See Table 5 |
| Viscosity modifier | See Table 5 |

The lubricating oil compositions were tested according to a Sequence VH engine test. The Sequence VH Test (ASTM D8256) is a test method used to evaluate an automotive engine oil's control of engine deposits under operating conditions deliberately selected to accelerate deposit formation. The engine is a spark-ignited engine fueled with gasoline and operated under low-temperature, light-duty conditions. Using a 2013 Ford 4.6 L fuel-injected, eight cylinder, gasoline engine with roller followers, coolant-jacketed rocker covers, and camshaft baffles.

The test duration is 216 hours involving 54 cycles, each cycle consisting of three different operating stages as shown in the following Table 4. Fuel containing sludge precursors is used, and engine blow-by is intentionally increased. The rocker cover jacket temperature is cycled.

TABLE 4

| Parameters of Test | | | |
|---|---|---|---|
| Time, minutes | Stage 1 | Stage 2 | Stage 3 |
| Time, minutes | 120 | 75 | 45 |
| Engine speed, rpm | 1200 | 2900 | 700 |
| Intake manifold absolute pressure, kPa | 69 | 66 | record |
| Lubricant temp, °C. | 68 | 100 | 45 |
| Coolant temp, °C. | 57 | 85 | 45 |
| Rocker cover temp, °C. | 29 | 85 | 29 |

One of the measurements included in the Sequence VH Test is of the Average Engine Varnish (AEV). Varnish deposits are rated on piston skirts (thrust) and rocker arm cover baffles. In accordance with the Sequence VH Test parameters, the oil passes the AEV test at 8.6 or higher. The results of the AEV test is given in Table 5 below.

TABLE 5

| Example Numbers | Wt. % of Viscosity Modifier[1] | Wt. % of Phosphorus from the ZDDP | (Wt. % of Phosphorus from the ZDDP)/(Wt. % of Viscosity Modifier) | Average Engine Varnish |
|---|---|---|---|---|
| CE-1 | 15.00 | 0.0772 | 0.0051 | 6.64 |
| CE-2 | 8.50 | 0.0632 | 0.0074 | 7.93 |
| IE-1 | 8.20 | 0.0637 | 0.0078 | 8.89 |
| IE-2 | 11.70 | 0.0998 | 0.0085 | 8.90 |
| IE-3 | 9.00 | 0.0772 | 0.0086 | 9.19 |
| IE-4 | 4.00 | 0.0787 | 0.0197 | 9.40 |
| IE-5 | 8.51 | 0.0974 | 0.0115 | 9.52 |

[1]The Viscosity Modifier was a nondispersant ethylene propylene copolymer having an SSI of about 25%.

The data in Table 5 demonstrate that there is improved resistance to varnish formation for lubricating oil compositions comprising greater than 50 wt. % of a base oil of lubricating viscosity, and an additive composition comprising: one or more zinc dialkyl dithiophosphates (ZDDP compounds) and one or more viscosity modifiers, wherein the amount of phosphorus (P) in weight percent provided to the lubricating oil composition by the one or more ZDDP compounds divided by the amount of the one or more viscosity modifiers (VM) in weight percent is a PNM quotient of more than about 0.0075. This is evident from the higher Average Engine Varnish values for Inventive Examples IE-1 to IE-5 when compared to the values for Comparative Examples CE-1 to CE-2.

The data in Table 5 also demonstrates that there is improved resistance to varnish formation for lubricating oil compositions formulated with a PNM quotient of greater than about 0.0075 and an amount of VM of less than 14 wt. %. This is evident from the higher Average Engine Varnish values for Inventive Examples IE-1 to IE-5 when compared to the values for Comparative Examples CE-1 to CE-2.

In addition, the data in Table 5 also demonstrates that there is improved resistance to varnish formation for lubricating oil compositions formulated with a PNM quotient of greater than about 0.0075 and an amount of P of at least 0.064 wt. %. This is evident from the higher Average Engine Varnish values for Inventive Examples IE-2 to IE-5 when compared to the values for Comparative Examples CE-1 to CE-2.

Other embodiments of the present disclosure will be apparent to those skilled in the art from consideration of the specification and practice of the embodiments disclosed herein. As used throughout the specification and claims, "a" and/or "an" and/or "the" may refer to one or more than one. Unless otherwise indicated, all numbers expressing quantities, proportions, percentages, or other numerical values are to be understood as being modified in all instances by the term "about." Accordingly, unless indicated to the contrary, the numerical parameters set forth in the specification and claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1-4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. An engine oil composition comprising greater than 50 wt. % of a base oil of lubricating viscosity, and an additive composition comprising:

an amount of one or more zinc dialkyl dithiophosphates (ZDDP compounds) and an amount of one or more viscosity modifiers, wherein an amount of phosphorus (P) in weight percent provided to the engine oil composition by the one or more ZDDP compounds divided by the amount of the one or more viscosity modifiers (VM) in weight percent based on a total weight of the engine oil composition is a P/VM quotient of more than about 0.0115, the viscosity modifier is a linear polyolefin consisting of ethylene and propylene and having a shear stability index (SSI) of from about 3% to less than 30%, as measured using test method ASTM-D6278, and the engine oil composition provides a result in an Average Engine Varnish test (ASTM D8256) of 9.40 or higher, and wherein the one or more ZDDP compounds comprise a ZDDP compound derived from 100% secondary alcohols which are a mixture of methyl isobutyl carbinol and isopropyl alcohol and the amount of phosphorus from the one or more ZDDP compounds is about 787 ppmw to 1200 ppmw.

2. The engine oil composition of claim 1, wherein the amount of VM is less than 14 wt. %.

3. The engine oil composition of claim 1, wherein the linear polyolefin has a polydispersity (Mw/Mn) ranging from about 1.5 to about 10.

4. The engine oil composition of claim 1, wherein the linear polyolefin has a shear stability index (SSI) of from about 3% to 25%, as measured using test method ASTM-D6278.

5. The engine oil composition of claim 1, further comprising at least one additive selected from the group consisting of dispersants, antioxidants, antiwear agents, antifoam agents, molybdenum-containing compounds, titanium-containing compounds, phosphorus-containing compounds, pour point depressants, and diluent oils.

6. A method of extending an oil drain interval of an internal combustion engine or reducing engine deposits of an internal combustion engine, the method comprising adding to the engine the engine oil composition of claim 1 and operating the engine.

7. A process of improving resistance to engine deposits of an engine oil, the process comprising incorporating an amount of one or more zinc dialkyl dithiophosphates (ZDDP compounds) and an amount of one or more viscosity modifiers, wherein an amount of phosphorus (P) in weight percent provided to the lubricating oil composition by the one or more ZDDP compounds divided by the amount of the one or more viscosity modifiers (VM) in weight percent based on a total weight of the lubricating oil composition is a P/VM quotient of more than about 0.0115, into a base oil to form the engine oil, the viscosity modifier is a linear polyolefin consisting of ethylene and propylene and having a shear stability index (SSI) of from about 3% to less than 30%, as measured using test method ASTM-D6278, and the engine oil composition provides a result in an Average Engine Varnish test (ASTM D8256) of 9.40 or higher, and wherein the one or more ZDDP compounds comprise a ZDDP compound derived from 100% secondary alcohols which are a mixture of methyl isobutyl carbinol and isopropyl alcohol and the amount of phosphorus from the one or more ZDDP compounds is about 787 ppmw to 1200 ppmw.

8. The engine oil composition of claim 1, wherein the polyolefin has a shear stability index (SSI) of from about 3% to 25%, as measured using test method ASTM-D6278 and the polyolefin comprises about 45 to about 55 weight percent ethylene and about 55 to about 45 weight percent propylene, wherein the weight percent is based on the total weight of the olefin polymer.

9. The process of claim 7, wherein the polyolefin has a shear stability index (SSI) of from about 3% to 25%, as measured using test method ASTM-D6278 and the polyolefin consists of about 45 to about 55 weight percent ethylene and about 55 to about 45 weight percent propylene, wherein the weight percent is based on the total weight of the olefin polymer.

10. The engine oil composition of claim 1, formulated for a passenger car engine, wherein the engine oil composition has a P/VM quotient of more than about 0.0115 and less than 0.03.

11. The process of claim 7, wherein the engine is a passenger car engine, and the engine oil composition has a P/VM quotient of more than about 0.0115 and less than 0.03.

* * * * *